United States Patent [19]

Boone

[11] Patent Number: 4,883,275

[45] Date of Patent: Nov. 28, 1989

[54] GOLD CLUB IRON HEAD

[75] Inventor: David D. Boone, El Toro, Calif.

[73] Assignee: Lynx Golf, Inc., City of Industry, Calif.

[21] Appl. No.: 167,209

[22] Filed: Mar. 11, 1988

Related U.S. Application Data

[63] Continuation-in-part of Ser. No. 59,212, Jun. 8, 1987, abandoned, which is a continuation of Ser. No. 887,735, Jul. 21, 1986, abandoned.

[51] Int. Cl.[4] ..... A63B 53/04

[52] U.S. Cl. ..... 273/172; 273/174; 273/167 H

[58] Field of Search ..... 273/169, 171, 172, 173, 273/174, 167 F, 167 R, 167 A, 167 H

[56] References Cited

U.S. PATENT DOCUMENTS 2,332,342 10/1943 Reach ..... 273/174

FOREIGN PATENT DOCUMENTS 2309 of 1908 United Kingdom ..... 273/169
1201648 8/1970 United Kingdom ..... 273/169

*Primary Examiner*—George J. Marlo
*Attorney, Agent, or Firm*—Leonard Tachner; Fred Flam

[57] ABSTRACT

An improved golf club iron head utilizes a composite structure of two different weight densities to transfer weight from the hosel and heel to the ball-impact region of the head. The disclosed embodiment comprises the combination of a lightweight composite material in the outlying structural portions of the head and a metallic insert to form the majority of the face, the sole and a backweight to improve weight distribution, utilization of material mass and control of the location of the center of gravity.

2 Claims, 7 Drawing Sheets

GOLD CLUB IRON HEAD

CROSS-REFERENCE TO RELATED APPLICATIONS

This application is a continuation-in-part of application Ser. No. 059,212 filed June 8, 1987 now abandoned which is, in turn, a continuation of application Ser. No. 887,735 filed July 21, 1986 now abandoned.

BACKGROUND OF THE INVENTION

1. Field of the Invention

The present invention relates to golf clubs and more specifically, to an improved golf club iron head which utilizes a lightweight composite non-metallic material in all outlying structural parts of the head and a metallic insert comprising the face, sole and backweight of the head for durability and superior weight distribution.

2. Prior Art

Golf clubs irons are classified as those golf clubs which are generally used for intermediate strokes usually between the teeing ground and the green where the hole is located. This contrasts with golf club woods which are generally used to achieve greater distances required off the teeing ground and putters which are designed to be used on or around the green area for attaining the ultimate objective which is to sink the golf ball into the hole. The present invention pertains specifically to the golf clubs classified generally as irons. A typical golf club iron comprises an elongated shaft terminating in what may be called an "iron head" which typically comprises a hosel, socket or neck portion which is designed to mate with the shaft, a heel to which the hosel socket or neck is connected, a sole which is the lower-most surface of the head and which extends generally horizontally from the bottom of the heel, a toe which extends upwardly from the sole opposite the heel and forms the forward-most surface of the head and a topline which extends generally parallel to the sole between the upper-most portions of the heel and toe. Within the generally rectangular frame formed by the heel, sole, toe and topline are two usually non-parallel surfaces comprising the face or front of the head which is the ball hitting surface thereof and the rear or back of the head which is not designed to contact the ball.

All prior art known to the applicant, that is, all previously available iron club heads of which the applicant is aware, are manufactured from some form of metal such as steel which forms the entire head or virtually the entire head. Some iron club heads may use a wrapping of an epoxy impregnated graphite but still use steel for the main frame and the force encountering structure such as the hosel. In particular, prior art iron club heads typically utilize metal for all structural parts including the hosel, socket or neck which affixes the club head to the shaft, for the structural component that attaches the hosel, socket or neck to the heel and for all portions of the golf club head which come into contact with the ball or the ground during use of the club including the sole, the toe and the face of the head. Typical materials used for these structural components of a golf club iron head comprise investment cast stainless steel and forged carbon steel.

SUMMARY OF THE INVENTION

The present invention comprises an improved golf club iron head which comprises a lightweight, composite non-metallic material in all outlying structural parts of the head in conjunction with a metallic insert forming the face, sole and backweight of the iron golf club head of the present invention. The resultant improved iron club head thereby provides a better weight distribution, a better utilization of the mass of the head and better control of the location of the center of gravity which tends to reduce the likelihood of an errant shot. Weight distribution is improved because a substantial portion of the weight of metal normally used in all outlying structural parts of the club head is transferred to the back of the club head behind the ball. Similarly, mass associated in the prior art with the hosel and heel areas is in large measure transferred to the sole, toe and face of the club head at or adjacent the region in contact with the ball.

OBJECTS OF THE INVENTION

It is therefore a principal object of the present invention to provide an improved iron club head which comprises a lightweight composite non-metallic material in all outlying structural parts of the club head.

It is an additional object of the present invention to provide an improved iron golf club head comprising the combination of a lightweight composite non-metallic material in outlying structural parts and a metallic insert forming the face, sole and backweight of the club head for durability and superior weight distribution heretofore not attainable in prior art iron club heads.

It is still an additional object of the present invention to provide an improved iron golf club head comprising a structure which combines metallic and non-metallic materials to transfer a predominent portion of the weight of the head to the back of the club head behind the ball impact portion of the face thereby providing improved weight distribution, utilization of mass and control of the location of the center of gravity.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
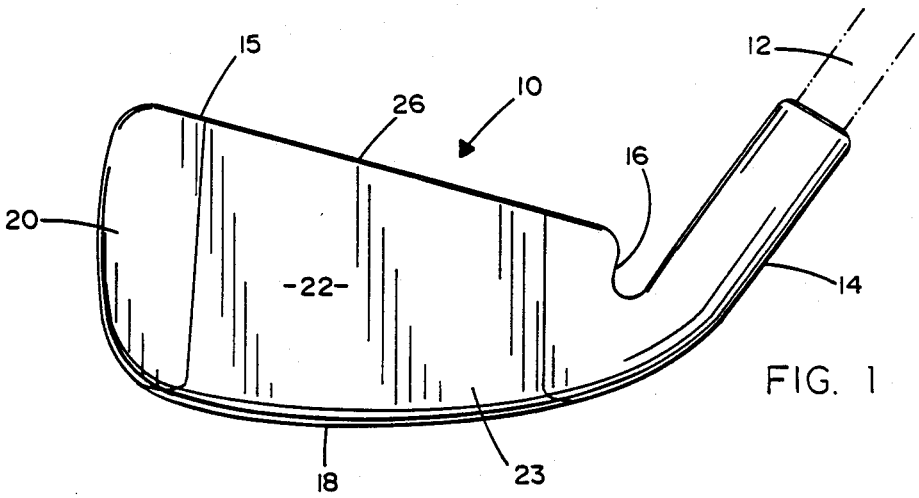
FIG. 1 is a frontal elevational view of the composite iron golf club head of a first embodiment of the present invention.
Figure 2:
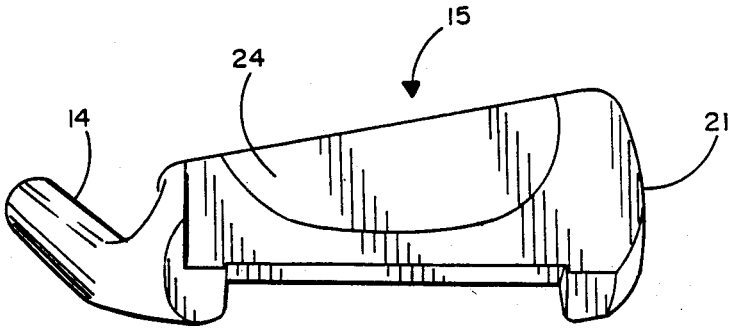
FIG. 2 is an elevational view of the composite outlying structure of the first embodiment of the invention directed toward the bottom rear portion of the club head.
Figure 3:
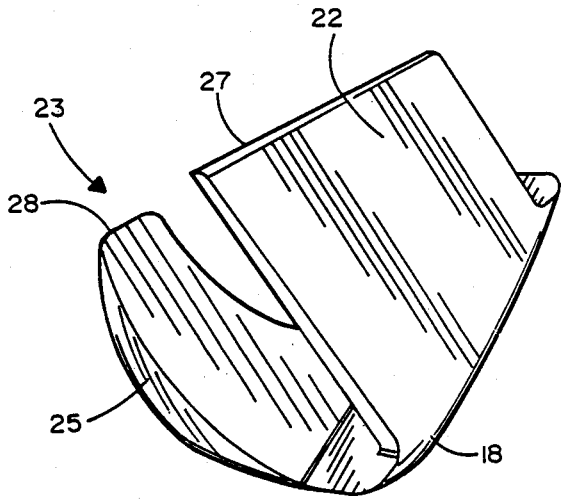
FIGS. 3–6 illustrate various views of the insert portion of the first embodiment of the invention.
Figure 4:
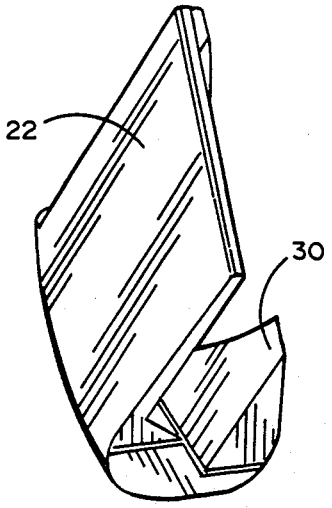
Figure 5:
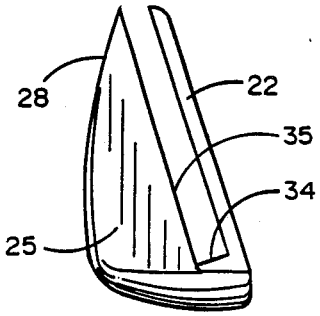
Figure 6:
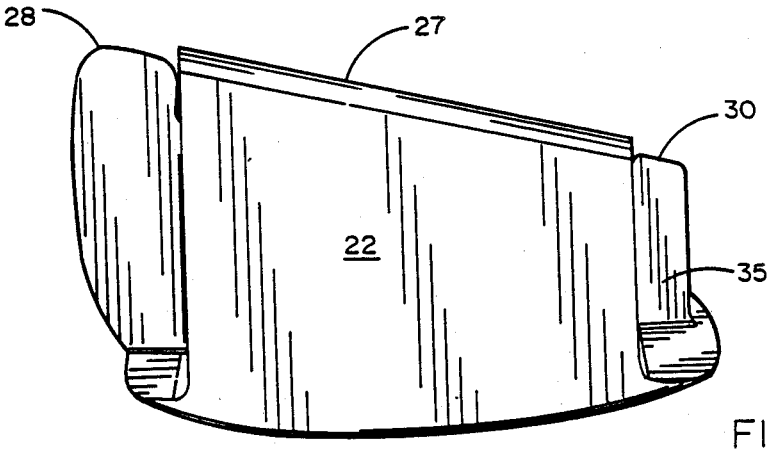
Figure 7:
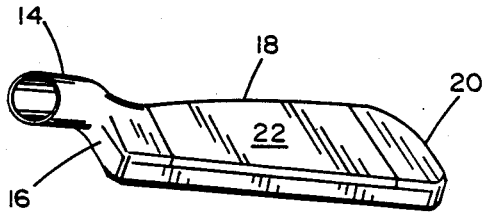
FIGS. 7–9 provide alternative top views of the assembled golf club head of the first embodiment of the invention.
Figure 8:
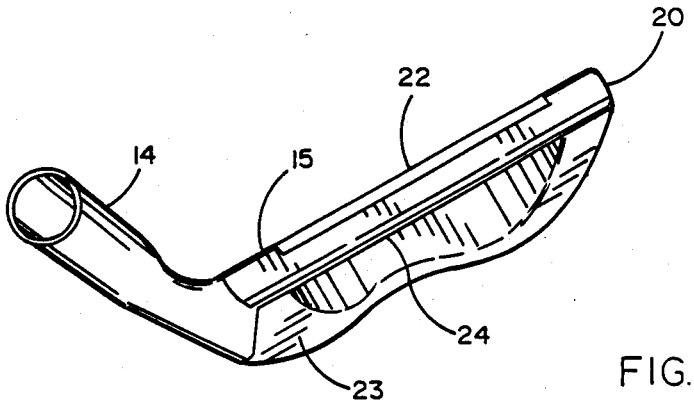
Figure 9:
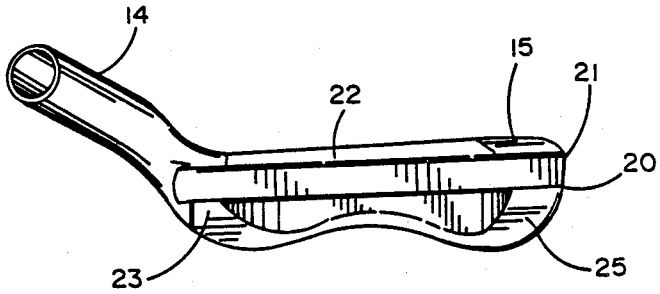
Figure 21:
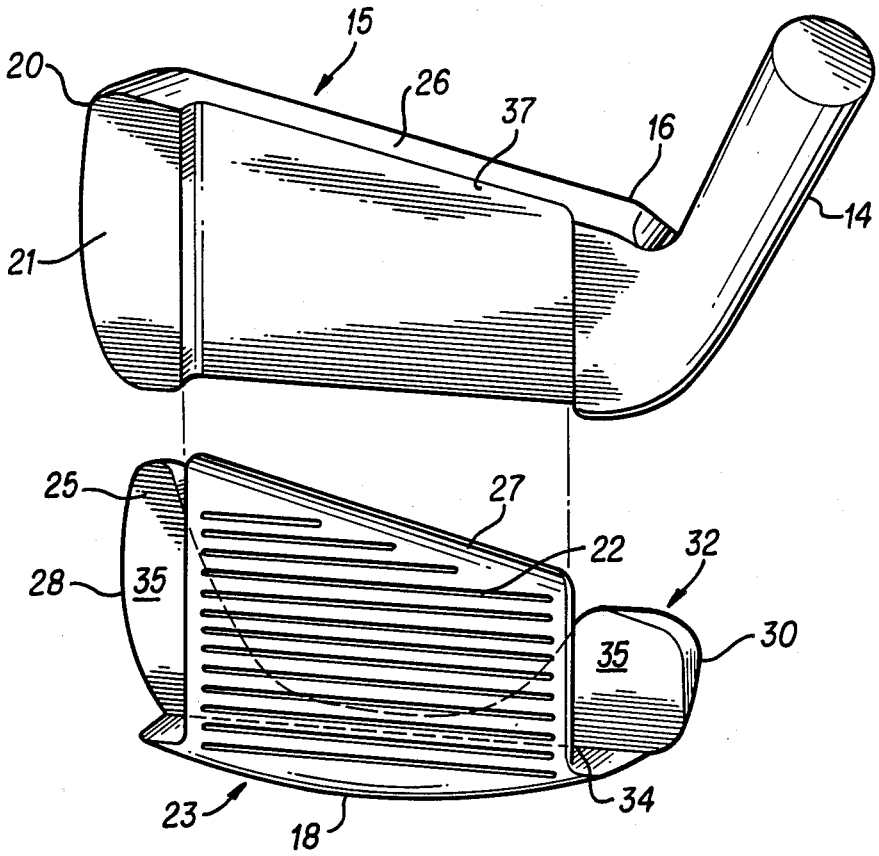

Referring first to FIG. 1 it will be seen that the improved iron club head 10 of the present invention is adapted to be connected to a golf club shaft 12 by means of a hosel 14. The hosel is that portion of head 10 which is adapted to receive the shaft 12 to provide interconnection between the head and the shaft. Unlike prior art golf club iron heads, the head 10 of the present invention comprises two distinct portions each made of separate types of material having different weight densities, namely, metallic on the one hand and non-metallic on the other. More specifically as shown in FIG. 21, the head 10 comprises a composite outlying structure 15 shown separately in FIG. 2 and a metal insert 23 shown separately in FIGS. 3–6. The combination of the composite outlying structure 15, which is made of a non-metallic material such as epoxy-impregnated graphite and the metallic insert 23, constitutes the assembled golf club iron head 10 which comprises in addition to hosel 14, heel 16, sole 18, toe 20, face or front surface 22, rear or back surface 24 and topline 26.

As seen best in FIGS. 3–10, the metal insert 23 is a unitary structure comprising an insert face portion 27 and a backweight 32 having a toe wing 28 and a heel wing 30. The backweight 32 has one surface 35 that is substantially parallel to the insert face portion 27 forming a channel 34 therebetween of substantially rectangular cross-section adapted to receive the composite outlying structure 15 as shown best in FIGS. 8–10. When the composite outlying structure 15 and insert 23 are integrated, the toe 20 of the completed structure is formed from both the insert 23 and the composite outlying structure 15 whereby a portion of the toe 20, namely, that portion closest to the face 22 of the head 10, is the composite toe portion 21 while that portion closest the rear 24 of the iron 10 is insert toe portion 25. On the other hand, the insert 23 forms the entire sole 18 of the integrated iron head 10 of the present invention.

It will be understood that the weight density, that is, the weight per unit volume of the material comprising the composite outlying structure 15, is substantially less than the weight per unit volume of the metal insert 23. As a result, the novel structure of the present invention has the effect of redistributing the weight of the iron head to those areas of the head which come in contact with the ball and which come into contact with the underlying surface. Consequently, much of the mass of all metal irons of the prior art, specifically including those portions of greater mass located in the area of the hosel and heel of the head, are transferred to the back of the club head behind the ball hitting surface whereby to improve the performance of the golf club in contact with the ball.

While it is recognized that there may be some relevant prior art in the manner in which wood golf club composite heads are manufactured, it is believed that the particular disclosed configuration of composite and metal structures integrated to gain better weight distribution and to position denser materials behind the ball hitting surface is a unique and surprising improvement resulting in superior golf club performance without deviating from the rules of the U.S. Golf Association.

A second embodiment of the invention is illustrated in FIGS. 11–20. This second embodiment 40 differs from the first embodiment 10 only in the shape of the region between the hosel and heel and in the precise shape of the metal insert. Accordingly, primed reference numerals illustrate analogous features as compared to the first embodiment. The differences between the first and second embodiments relate primarily to alternative preferences in structural integrity and in ease of manufacture. Thus for example, as seen best in FIGS. 11 and 12, the region between the hosel 14′ and the heel 16′ is thicker and more continuous in the second embodiment thereby adding to the strength of the composite outlying structure 15′ at a critical location in the structure. In addition, metal insert 23′ of the second embodiment utilizes smoother surfaces and a more easily shaped channel 34′.

Figure 10:
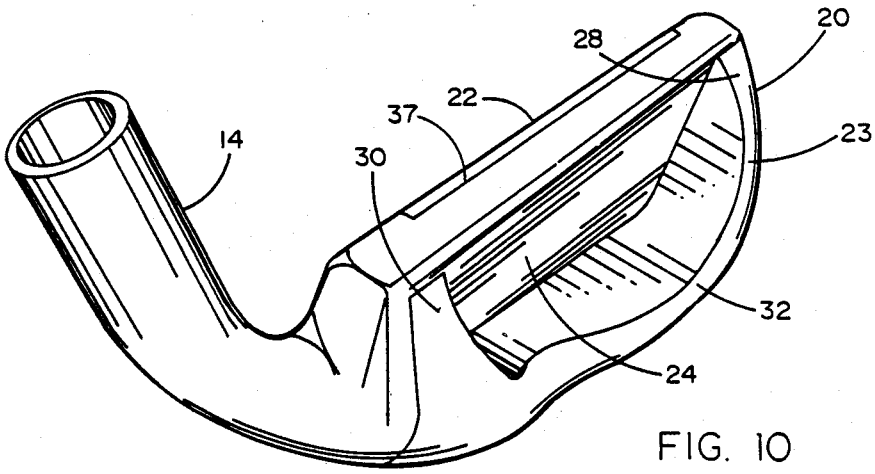
FIG. 10 is an isometric view of the assembled golf club head of the first embodiment of the invention illustrating primarily the backweight and rear face portions of the club head.
Figure 11:
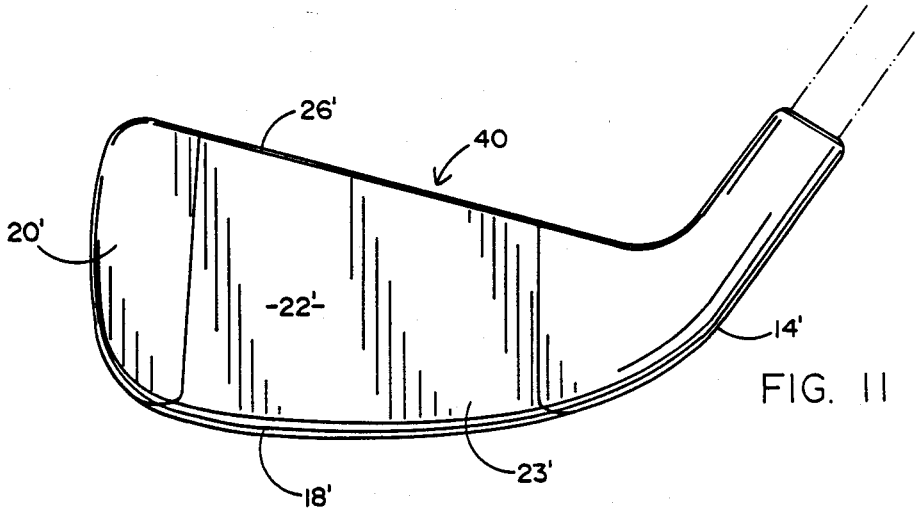
FIG. 11 is a frontal elevational view of the composite iron golf club head of a second embodiment of the invention.
Figure 12:
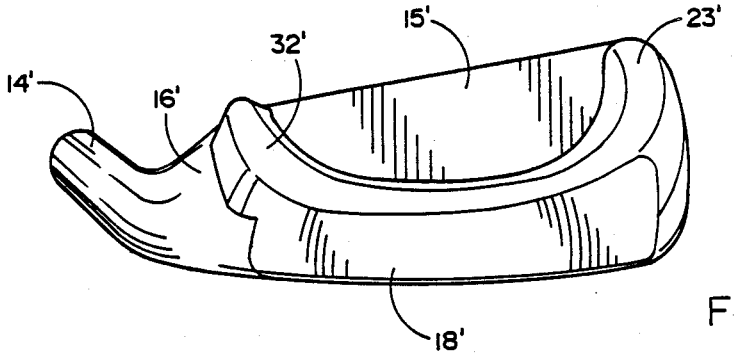
FIG. 12 is a bottom rear elevational view of the embodiment of FIG. 11.
Figure 13:
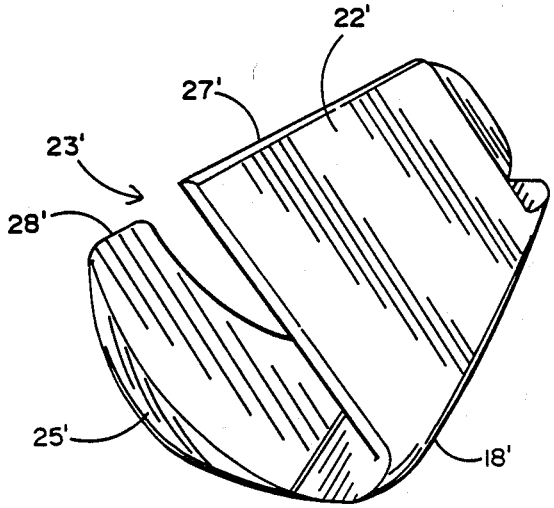
FIGS. 13–16 illustrate various views of the insert portion of the second embodiment.
Figure 14:
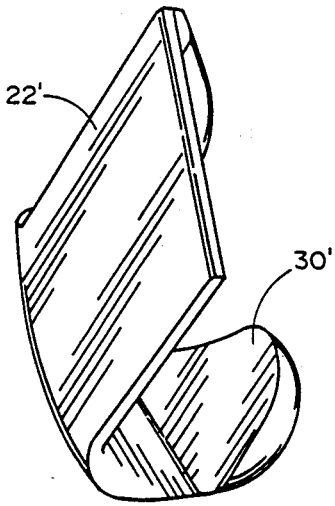
Figure 15:
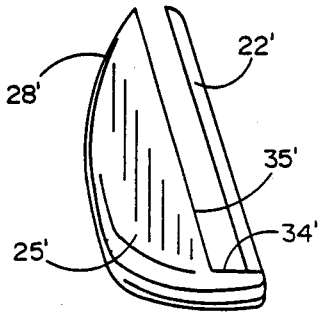
Figure 16:
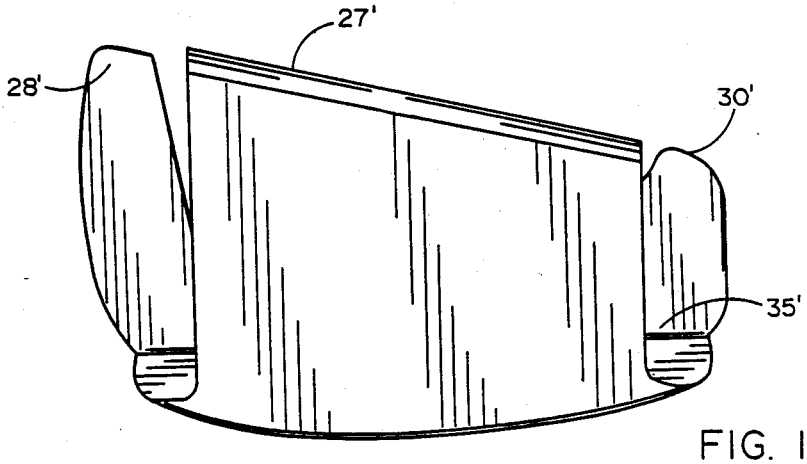
Figure 17:
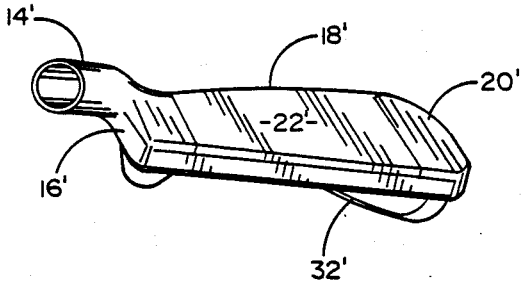
FIGS. 17–19 provide alternative top views of the assembled golf club head of the second embodiment.
Figure 18:
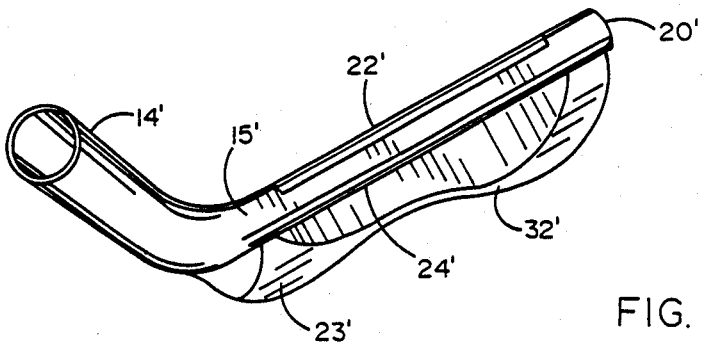
Figure 19:
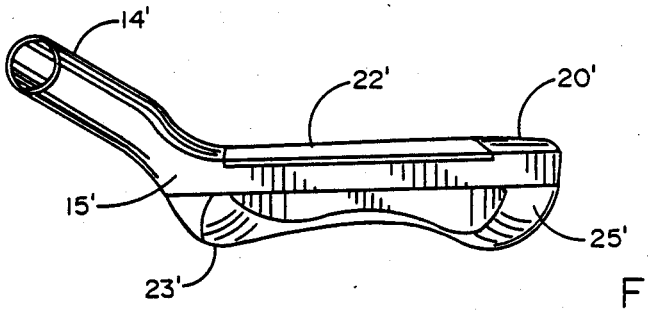
Figure 20:
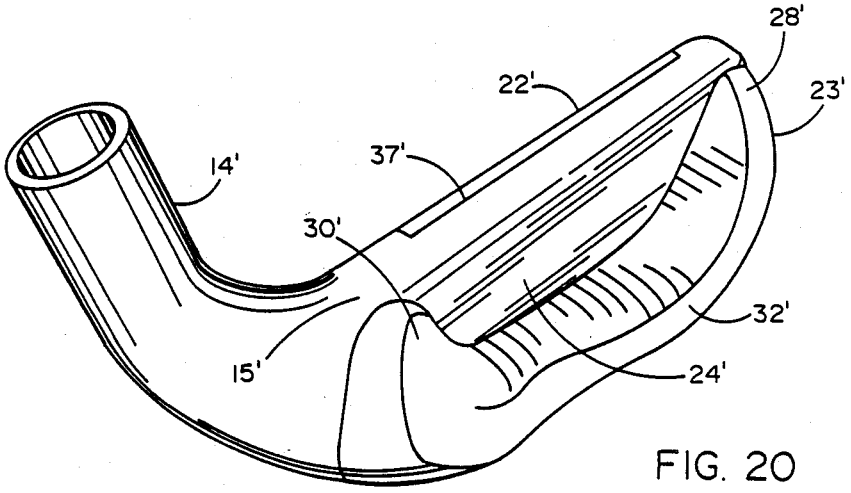
FIG. 20 is an isometric view of the second embodiment similar to that of FIG. 10; and, FIG. 21 is a perspective exploded view of the first embodiment of the invention.

It should be noted that in both embodiments 10 and 40, a key feature of the invention is the generally planar portion of the composite outlying structure which forms a recess 37 seen in FIG. 10 (and recess 36′ seen in FIG. 20) which is designed to receive the hitting surface of the metal insert whereby the recess and the hitting surface jointly define the topline of the club head.

Those having skill in the art to which the present invention pertains will now, as a result of applicant's teaching herein, understand that what has been disclosed comprises an improved golf club iron head comprising a novel structure having a combination of a metallic insert and non-metallic outlying structure. The insert provides a substantially greater mass redistributed adjacent the ball contact area of the club head whereby to increase the performance of the golf club by decreasing the possibility of an errant stroke irrespective of where the ball comes in contact with the face of the club. More specifically, as a result of the novel structure herein described, there is a substantial reduction in the mass of the head in the hosel and heel areas and a transfer of the weight from those areas to the back of the club head behind the ball hitting area whereby to better utilize weight and mass distribution and better control the location of the center of gravity of the head.

As a result of the applicant's disclosure herein it will now be apparent to those skilled in the art to which the present invention pertains, that various modifications and additions may be made to the invention. By way of example, the precise shape of the metal insert and the composite outlying structure of the present invention may be altered without deviating from the underlying concept of the invention to utilize such a composite structure. Furthermore, specific materials referred to herein may be replaced by alternative materials which still achieve the desired weight distribution and superior golf club performance referred to herein. Accordingly, all such modifications and additions are deemed to be within the scope of the invention which is to be limited only by the claims appended hereto.

I claim:

1. A golf club iron head (10) defining a hosel (14) coupled to a heel portion (16), said heel portion (16) being coupled to a toe portion (20) by a sole portion (18), and a ball striking surface (22) located between said toe (20) and heel (16), comprising:

a first unitary member (15) defining the hosel (14), and a front portion of said heel (16) and a toe portion (21) of said head (10), said first unitary member

(15) having a recess (37) formed between said heel (16) and toe (21) front portions defining a substantially planar surface, said planar surface of said recess (37) being substantially parallel to said striking surface of said head (10);

a second unitary member (23) having (a) a front face member (27) defining said ball striking surface (22), (b) said sole (18), and (c) an integral backweight (32) extending upward from said sole (18) in rearwardly spaced parallel relation to said front face member (27) and defining a rear portion of said heel (30) and a rear portion of said toe (28), wherein said backweight is substantially continuous from said heel to said toe; said second unitary member (23) having a channel (34) formed between said backweight (32) and said front face member (27);

said channel (34) receiving said first unitary member (15) and said recess (37) receiving said front face member (27) to form a contiguous frontal surface of said head (10), wherein said toe (21) and heel (16) portions of said first unitary member (15) are substantially coplanar with said ball striking surface (22) of said second unitary member (23), said front face member (27) having an upper edge substantially coplanar with an upper surface of said first unitary member (15);

the weight density of said second unitary member (23) being greater than the weight density of said first unitary member (15);

whereby said front face member (27) is matingly engaged within said recess (37) for locking engagement with said first unitary member (15) in a transverse direction with respect to a direction line substantially orthogonal to said ball striking surface (22).

2. The golf club iron head recited in claim 1 wherein said first unitary member is made of epoxy-impregnated graphite and said second unitary member is made of steel.

* * * * *